US007472853B2

(12) United States Patent
Petersen

(10) Patent No.: US 7,472,853 B2
(45) Date of Patent: Jan. 6, 2009

(54) ROLLER MILL

(75) Inventor: Luis Petersen, Valby (DK)

(73) Assignee: FLSMIDTH A/S, Valby (SE)

( * ) Notice: Subject to any disclaimer, the term of this patent is extended or adjusted under 35 U.S.C. 154(b) by 73 days.

(21) Appl. No.: 11/576,063

(22) PCT Filed: Jun. 12, 2006

(86) PCT No.: PCT/IB2006/051859

§ 371 (c)(1),
(2), (4) Date: Mar. 27, 2007

(87) PCT Pub. No.: WO2007/004082

PCT Pub. Date: Jan. 11, 2007

(65) Prior Publication Data

US 2008/0149745 A1 Jun. 26, 2008

(30) Foreign Application Priority Data

Jul. 5, 2005 (DK) ..... 2005 00993

(51) Int. Cl.
*B02C 15/00* (2006.01)

(52) U.S. Cl. ..... 241/19; 241/23; 241/57; 241/119

(58) Field of Classification Search ..... 241/117–121, 241/19, 23, 57
See application file for complete search history.

(56) References Cited

U.S. PATENT DOCUMENTS 3,658,264 A 4/1972 Schauer

FOREIGN PATENT DOCUMENTS

EP 0280897 A3 9/1988
GB 2053728 A 2/1981

*Primary Examiner*—Mark Rosenbaum
(74) *Attorney, Agent, or Firm*—Jeffrey S. Melcher; Manelli Denison & Selter, PLLC

(57) ABSTRACT

Described is a roller mill (1) for grinding particulate material such as cement raw materials, cement clinker and similar materials, said roller mill (1) comprising a housing (3) which surrounds a grinding table (7) which is rotatable about a vertical axis (5), said grinding table being supported via a support (9) by a machine foundation (11), at least one roller (13) rotatable about a substantially stationary axis (12), said roller being configured for interaction with the grinding table (7) and an electric motor (15), which comprises a rotor (16) which is firmly connected to the grinding table (7) and a stator (17). The roller mill is peculiar in that the stator (17) constitutes an integral part of the support (9) for the grinding table (7), so that at least some of the load imposed by the at least one roller (13) on the grinding table (7) is transmitted via the stator (17) to the machine foundation (11).

9 Claims, 1 Drawing Sheet

ROLLER MILL

Figure 1:
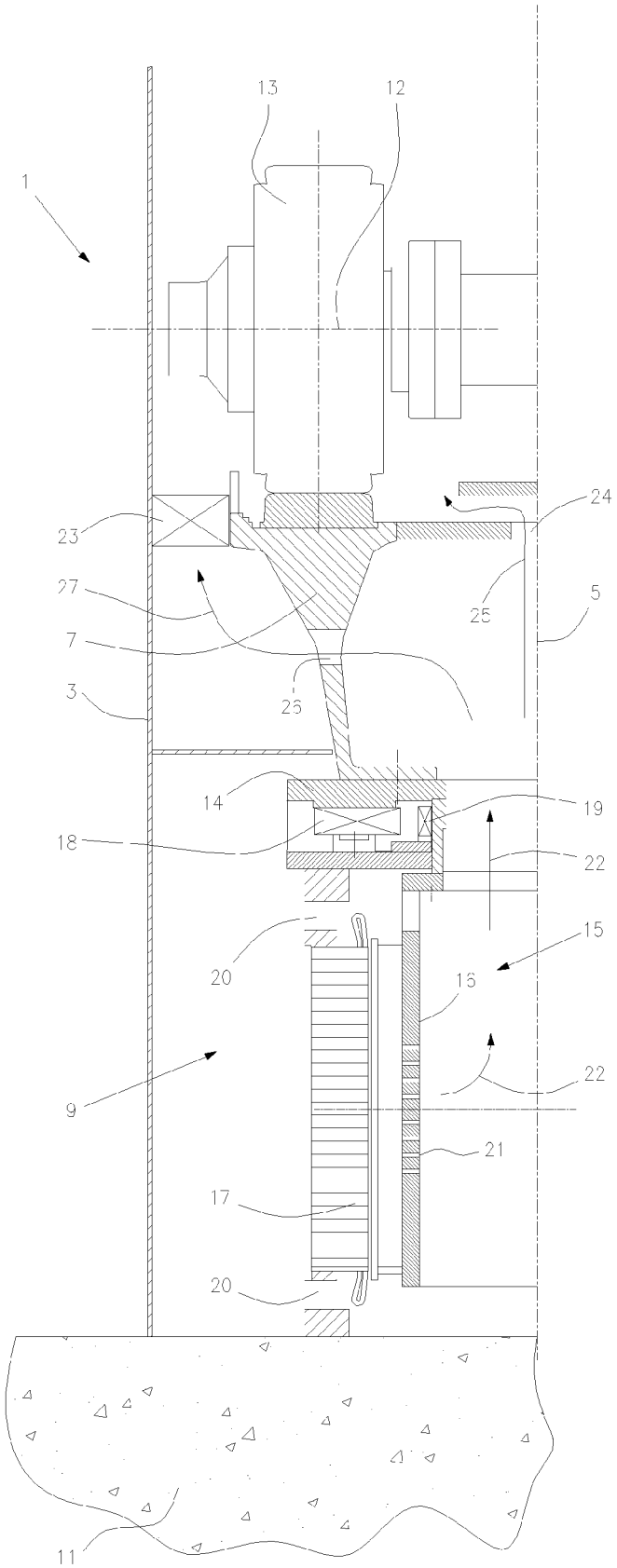

The present invention relates to a roller mill for grinding particulate material such as cement raw materials, cement clinker and similar materials, said roller mill comprising a housing which surrounds a grinding table which is rotatable about a vertical axis, said grinding table being supported via a support by a machine foundation, at least one roller rotatable about a substantially stationary axis, said roller being configured for interaction with the grinding table and an electric motor, which comprises a rotor which is firmly connected to the grinding table and a stator.

A roller mill of the aforementioned kind is known for example from UK patent No. 1 285 102. By this known mill a part of the outer periphery of the grinding table is configured as a rotor of an electric motor and being surrounded by a stator which is supported by the mill housing. The disadvantage of this known mill is the relative complexity of installation and repairs due to the need for magnetic/electrical activation of the stator in connection with the in-situ installation of the stator which is a very elaborate operation which involves stringent demands in terms of precision.

From DE 10305915 is also known a roller mill of the aforementioned kind in which the downwardly directed force imposed by the grinding rollers upon the grinding table is transmitted via the rotor of the ring motor and a roller bearing design to a machine frame or foundation which also supports the ring motor stator. The disadvantage of this mill is that in instances where radial forces act upon the grinding surface this may subject the bearing design to a quite substantial tilting moment which will be directly proportional to the distance between the grinding surface plane and the horizontal plane of the bearing since this distance for the known mill is quite substantial.

It is the object of the present invention to provide a roller mill by means of which the aformentioned disadvantages are eliminated or at least significantly reduced.

This is achieved by a roller mill of the kind mentioned in the introduction and being characterized in that the stator constitutes an integral part of the support for the grinding table, so that at least some of the load imposed by the at least one roller on the grinding table is transmitted via the stator to the machine foundation.

Hence it will be possible to install and replace the electric motor as a single unit which has been preassembled at a specialized workshop. This is due to the fact that none of the motor parts are connected to the housing of the mill and, therefore, the installation and dismantling of the motor will be relatively simple. By displacing the bearing design between the rotating and the fixed parts of the mill upwards in direction of the grinding table, so that the stator constitutes a part of the support for the grinding table, it will also be possible to reduce significantly the tilting moment occurring in instances where radial forces act upon the grinding surface.

The invention will now be described in further details with reference to the drawing, being diagrammatical, with the only FIGURE of the drawing showing a section of the roller mill according to the invention.

In the FIGURE is seen a sectional view of a roller mill 1 which comprises a housing 3 which surrounds a grinding table 7 rotatable about a vertical axis 5, said table being supported via a support 9 by a machine foundation 11, at least one roller 13 which is rotatable about a substantially stationary axis 12 which roller is designed for interaction with the grinding table 7, and an electric motor 15 which comprises a rotor 16 which is firmly connected to the grinding table 7 and a stator 17.

According to the invention the stator 17 constitutes an integral part of the support 9 which also comprises a slide ring 14 to which the grinding table 7 is fixed, an axial bearing 18 on which the slide ring 14 is moving during the rotation of the grinding table 7 during the operation of the mill, and a radial bearing 19 which controls the radial movement of the grinding table 7. Hence the entire support 9 which makes up the electric motor can be installed and replaced as a single unit, while at the same time the specific tilting moment absorbed by the radial bearing 19 is significantly reduced.

During the operation of the roller mill a certain amount of heat equivalent to about 6 to 8 per cent of the motor output will be generated by the motor, and this heat should be continuously diverted. According to a further aspect of the invention this can be done by introducing cooling air through openings 20 in the stator. The cooling air introduced will pass through the area between the stator 17 and the rotor 16 and after having absorbed heat from these elements it will be discharged through openings 21 in the rotor. The cooling air can subsequently be led further upstream through the central free room in the rotor 16 and the grinding table 7 as shown by the arrows 22 and onward into the mill housing via an opening 24 as shown by the arrow 25 where it is used as process air. Alternatively, the cooling air may be introduced into the housing of the mill via openings 26 provided in the grinding table 7 and a nozzle ring 23 which surrounds the grinding table 7 as shown by the arrow 27.

The invention claimed is:

1. Roller mill for grinding particulate material comprising:

a housing which surrounds a grinding table which is rotatable about a vertical axis, said grinding table being supported via a support by a machine foundation;

at least one roller rotatable about a substantially stationary axis, said roller being configured for interaction with the grinding table; and an electric motor, which comprises a rotor which is firmly connected to the grinding table and a stator, wherein the stator comprises an integral part of the support for the grinding table so that at least some of the load imposed by the at least one roller on the grinding table is transmitted via the stator to the machine foundation.

2. Roller mill according to claim 1, wherein the particulate material comprises cement raw materials.

3. Roller mill according to claim 1, further comprising means for introducing cooling air into the area between the stator and the rotor.

4. Roller mill according to claim 3, further comprising means for introducing cooling air leaving the area between the stator and the rotor into the housing of the mill.

5. A method of using a roller mill for grinding particulate material, the roller mill comprising a housing which surrounds a grinding table which is rotatable about a vertical axis, said grinding table being supported via a support by a machine foundation; at least one roller rotatable about a substantially stationary axis, said roller being configured for interaction with the grinding table; and an electric motor, which comprises a rotor which is firmly connected to the grinding table and a stator, wherein the stator comprises an integral part of the support for the grinding table so that at least some of the load imposed by the at least one roller on the grinding table is transmitted via the stator to the machine foundation, the method comprising grinding a particulate material using the roller mill.

6. The method according to claim 5, wherein the particulate material comprises cement raw materials.

7. The method according to claim 6, wherein the particulate material comprises cement clinker.

8. The method according to claim 5, further comprising introducing cooling air into the area between the stator and the rotor.

9. The method according to claim 8, further comprising introducing cooling air leaving the area between the stator and the rotor into the housing of the mill.

* * * * *